US009533851B2

(12) United States Patent
Kunihiro

(10) Patent No.: US 9,533,851 B2
(45) Date of Patent: Jan. 3, 2017

(54) CONTROL DEVICE FOR CONTROLLING SHEET CONVEYANCE OPERATION DURING PRINTING, METHOD FOR CONTROLLING CONTROL DEVICE, AND STORAGE MEDIUM

(71) Applicant: CANON KABUSHIKI KAISHA, Tokyo (JP)

(72) Inventor: Syunichi Kunihiro, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/830,605

(22) Filed: Aug. 19, 2015

(65) Prior Publication Data

US 2016/0052737 A1 Feb. 25, 2016

(30) Foreign Application Priority Data

Aug. 22, 2014 (JP) ..... 2014-169779

(51) Int. Cl.

| | |
|---|---|
| ***B65H 7/20*** | (2006.01) |
| ***B65H 7/08*** | (2006.01) |
| ***B41J 29/38*** | (2006.01) |
| ***B65H 85/00*** | (2006.01) |
| ***B65H 3/44*** | (2006.01) |

(Continued)

(52) U.S. Cl.

CPC ..... *B65H 7/20* (2013.01); *B41J 29/38* (2013.01); *B65H 3/44* (2013.01); *B65H 7/08* (2013.01); *B65H 7/10* (2013.01); *B65H 9/006* (2013.01); *B65H 85/00* (2013.01); *B65H 2511/20* (2013.01); *B65H 2511/242* (2013.01); *B65H 2513/42* (2013.01); *B65H 2513/53* (2013.01);

(Continued)

(58) Field of Classification Search

CPC ..... B65H 5/00; B65H 3/44; B65H 7/00; B65H 7/02; B65H 7/20; B65H 43/00; B65H 2553/00; B65H 2557/20; B65H 85/00; B65H 2301/332; B65H 2301/333; B41J 13/32; B41J 2/04501; B41J 29/38; B41J 29/393; B41J 11/42

USPC ..... 271/9.01, 9.05, 9.13, 265.01, 10.01, 65, 271/301, 291; 347/104

See application file for complete search history.

(56) References Cited

U.S. PATENT DOCUMENTS 4,275,879 A * 6/1981 Yamashita ..... B65H 7/20 271/259
8,495,957 B2 * 7/2013 Kato ..... G03G 15/6508 101/118

(Continued)

FOREIGN PATENT DOCUMENTS

JP 62-38261 B2 8/1987
JP 2004-338119 A 12/2004

*Primary Examiner* — David H Bollinger
(74) *Attorney, Agent, or Firm* — Canon U.S.A., Inc. IP Division

(57) ABSTRACT

A control device includes a detection unit configured to detect a position of a fed sheet in a direction intersecting with a conveyance direction of the sheet, and a setting unit configured to set a print start position in the direction intersecting with the conveyance direction based on the position of the sheet detected by the detection unit. The detection unit detects the position of the sheet in a case where the sheet is fed from a first feeding unit, and does not detect the position of the sheet in a case where the sheet is fed from a second feeding unit, the first feeding unit and the second feeding unit being among a plurality of feeding units that are different from each other in a distance to a printing unit.

18 Claims, 10 Drawing Sheets

(51) Int. Cl.
*B65H 7/10* (2006.01)
*B65H 9/00* (2006.01)

(52) U.S. Cl.
CPC ... *B65H 2553/81* (2013.01); *B65H 2701/1315* (2013.01); *B65H 2801/12* (2013.01)

(56) References Cited

U.S. PATENT DOCUMENTS

| | | | | |
|---|---|---|---|---|
| 2011/0057974 | A1* | 3/2011 | Kobayashi | B41J 11/42 347/14 |
| 2013/0002750 | A1* | 1/2013 | Takenouchi | B41J 29/38 347/16 |
| 2014/0042688 | A1* | 2/2014 | Suzuki | B65H 5/00 271/9.01 |
| 2015/0076763 | A1* | 3/2015 | Katsura | B65H 7/02 271/227 |

* cited by examiner

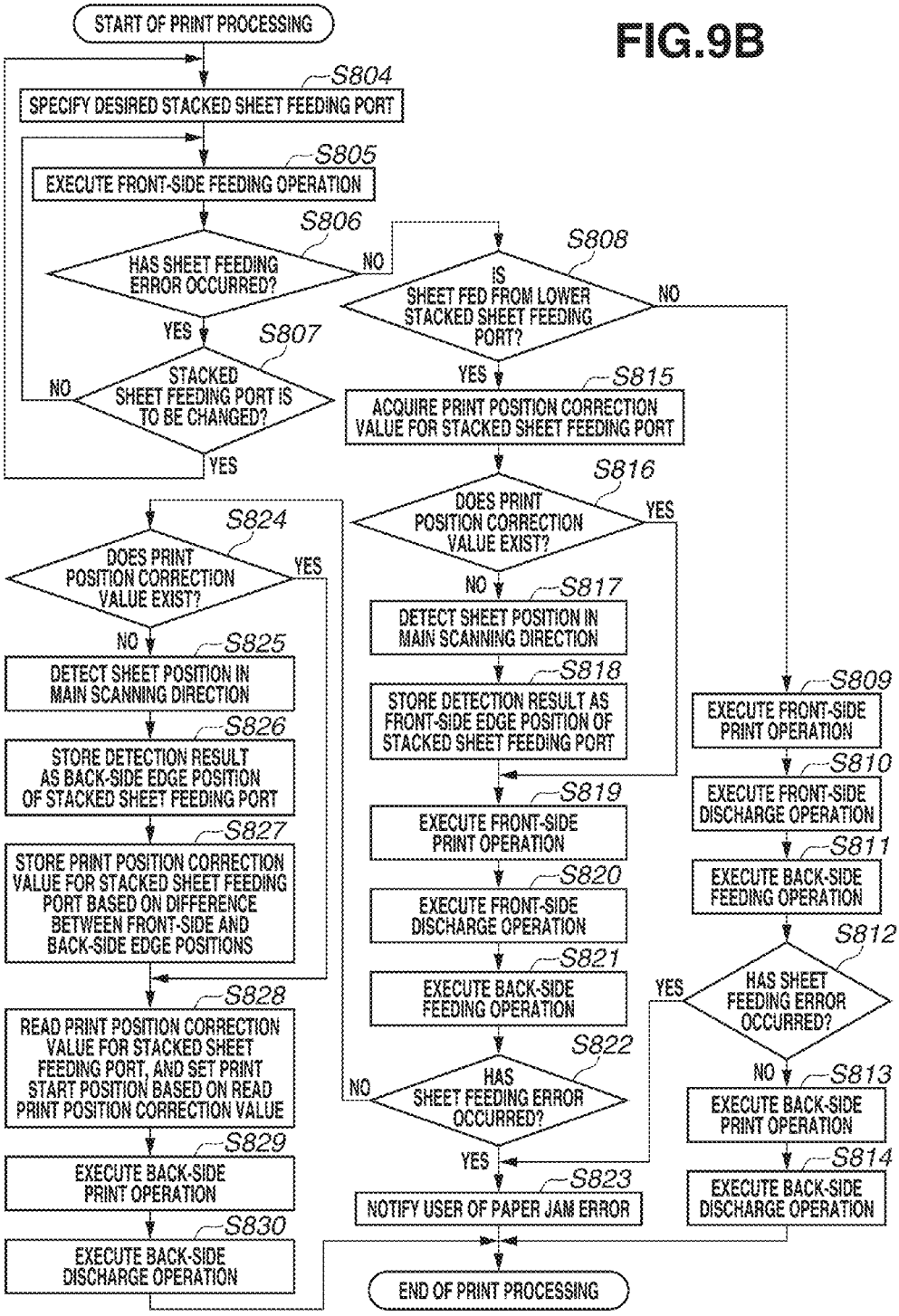
FIG.9B
START OF PRINT PROCESSING
S804
SPECIFY DESIRED STACKED SHEET FEEDING PORT
S805
EXECUTE FRONT-SIDE FEEDING OPERATION
S806
HAS SHEET FEEDING ERROR OCCURRED?
NO
YES
S807
STACKED SHEET FEEDING PORT IS TO BE CHANGED?
NO
YES
S808
IS SHEET FED FROM LOWER STACKED SHEET FEEDING PORT?
NO
YES
S815
ACQUIRE PRINT POSITION CORRECTION VALUE FOR STACKED SHEET FEEDING PORT
S816
DOES PRINT POSITION CORRECTION VALUE EXIST?
YES
NO
S817
DETECT SHEET POSITION IN MAIN SCANNING DIRECTION
S818
STORE DETECTION RESULT AS FRONT-SIDE EDGE POSITION OF STACKED SHEET FEEDING PORT
S819
EXECUTE FRONT-SIDE PRINT OPERATION
S820
EXECUTE FRONT-SIDE DISCHARGE OPERATION
S821
EXECUTE BACK-SIDE FEEDING OPERATION
S822
HAS SHEET FEEDING ERROR OCCURRED?
NO
YES
S823
NOTIFY USER OF PAPER JAM ERROR
S824
DOES PRINT POSITION CORRECTION VALUE EXIST?
YES
NO
S825
DETECT SHEET POSITION IN MAIN SCANNING DIRECTION
S826
STORE DETECTION RESULT AS BACK-SIDE EDGE POSITION OF STACKED SHEET FEEDING PORT
S827
STORE PRINT POSITION CORRECTION VALUE FOR STACKED SHEET FEEDING PORT BASED ON DIFFERENCE BETWEEN FRONT-SIDE AND BACK-SIDE EDGE POSITIONS
S828
READ PRINT POSITION CORRECTION VALUE FOR STACKED SHEET FEEDING PORT, AND SET PRINT START POSITION BASED ON READ PRINT POSITION CORRECTION VALUE
S829
EXECUTE BACK-SIDE PRINT OPERATION
S830
EXECUTE BACK-SIDE DISCHARGE OPERATION
S809
EXECUTE FRONT-SIDE PRINT OPERATION
S810
EXECUTE FRONT-SIDE DISCHARGE OPERATION
S811
EXECUTE BACK-SIDE FEEDING OPERATION
S812
HAS SHEET FEEDING ERROR OCCURRED?
YES
NO
S813
EXECUTE BACK-SIDE PRINT OPERATION
S814
EXECUTE BACK-SIDE DISCHARGE OPERATION
END OF PRINT PROCESSING

CONTROL DEVICE FOR CONTROLLING SHEET CONVEYANCE OPERATION DURING PRINTING, METHOD FOR CONTROLLING CONTROL DEVICE, AND STORAGE MEDIUM

BACKGROUND OF THE INVENTION

Field of the Invention

The present invention relates to a control device for controlling a sheet conveyance operation during printing, a method for controlling the control device, and a storage medium.

Description of the Related Art

In a printing apparatus, a difference in the distance to convey a sheet to a printing unit may cause a variation in the print start position of the sheet. In both-sided printing, after printing is executed on the front side, the sheet is turned to the back side and conveyed through a conveyance path for back-side printing. If a displacement of the sheet occurs in the direction orthogonal to the conveyance direction of the sheet while the sheet is conveyed for the back-side printing, there arises a problem that the print positions of the front side and the back side are different from each other. Such a positional displacement between the front side and back side occurs because a minute tilt of the sheet caused when the sheet has been stacked increases as the sheet is conveyed through the conveyance path. Therefore, Japanese Patent Application Laid-Open No. 2004-338119 discusses an image forming apparatus capable of correcting the print start position of an image based on a positional displacement amount of a recording medium.

However, in the image forming apparatus described in Japanese Patent Application Laid-Open No. 2004-338119, detection of a sheet edge position in a main scanning direction is executed on all sheets (i.e., on a sheet-by-sheet basis) when a front-side conveyance operation and a back-side conveyance operation are executed. Therefore, detection time is required after the front-side feeding operation and also after the back-side feeding operation, and this takes a longer time for the print operation.

Further, in a printing apparatus including a plurality of sheet feeding cassettes, the upper and lower sheet feeding cassettes are different from each other in the length of the conveyance path to the printing unit, for example, and a sheet fed from a sheet feeding cassette having a longer conveyance distance is more likely to cause a displacement in the direction orthogonal to the conveyance direction. However, in Japanese Patent Application Laid-Open No. 2004-338119, only a correction method for a single sheet feeding cassette is described.

SUMMARY OF THE INVENTION

According to an aspect of the present invention, a control device includes a detection unit configured to detect a position of a fed sheet in a direction intersecting with a conveyance direction of the sheet, and a setting unit configured to set a print start position in the direction intersecting with the conveyance direction based on the position of the sheet detected by the detection unit. The detection unit detects the position of the sheet in a case where the sheet is fed from a first feeding unit, and does not detect the position of the sheet in a case where the sheet is fed from a second feeding unit, the first feeding unit and the second feeding unit being among a plurality of feeding units that are different from each other in a distance to a printing unit.

Further features of the present invention will become apparent from the following description of exemplary embodiments with reference to the attached drawings.

BRIEF DESCRIPTION OF THE DRAWINGS

FIGS. 9A and 9B are flowcharts illustrating control processing of two-sided printing executed by a printing apparatus according to a second exemplary embodiment of the present invention.

DESCRIPTION OF THE EMBODIMENTS

Hereinafter, exemplary embodiments of the present invention will be described in detail with reference to the drawings. A relative arrangement of components of an apparatus described in the exemplary embodiments and a shape of the apparatus are merely examples, and are not limited thereto.

Figure 1:
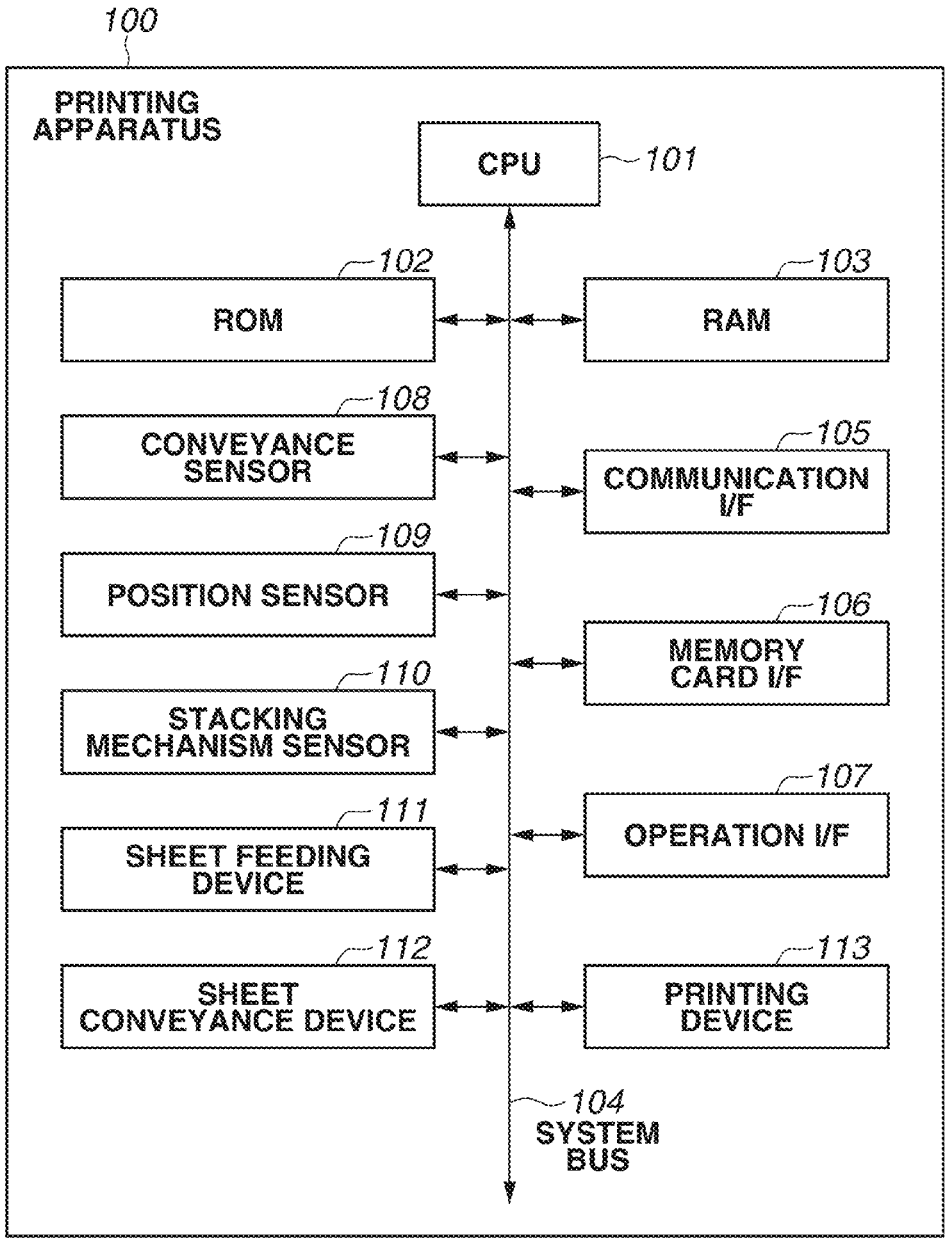
FIG. 1 is a block diagram illustrating a configuration of a printing apparatus according to a first exemplary embodiment of the present invention.

FIG. 1 is a diagram illustrating a configuration of a printing apparatus according to a first exemplary embodiment of the present invention. For example, the printing apparatus may be a single function printer having only a printing function, or may be a multifunction peripheral (MFP) having a plurality of functions such as a printing function, a facsimile function, and a scanner function. Further, for example, the printing apparatus may be a manufacturing apparatus for manufacturing a color filter, an electronic device, an optical device, or a microstructure through a predetermined printing method. Furthermore, in the present exemplary embodiment, a sheet of paper is described as an example of a recording medium. However, the material of the recording medium is not limited to paper, and various recording media can be used as long as print processing can be executed thereon. Further, a method for printing an image is not limited to an ink jet printing method using image printing liquid ink (described below). Various printing methods such as a printing method using solid ink as a recording material, an electro-photographic method using toner, and a dye sublimation printing method can be employed. In addition to a printing method for executing color printing using recording materials in a plurality of colors, a printing method for executing black-and-white printing using a recording material in black color (or grey color) may also be employed. Further, the print processing is not limited to print processing for a visible image. Print processing for an invisible image or an image that is difficult to visually identify, or print processing for an object, other than a general image, such as a wiring pattern, a physical pattern for manufacturing a component, or a deoxyribonucleic acid (DNA) base sequence may be executed. In short, the present exemplary embodiment is applicable to various printing apparatuses as long as the printing apparatus can apply a recording material to a recording medium.

A printing apparatus 100 according to the present exemplary embodiment includes a central processing unit (CPU) 101 for executing a program, a read only memory (ROM) 102 for storing a program, and a random access memory (RAM) 103 for storing information necessary to execute a program, each of which is connected to one another through a system bus 104. The CPU 101 executes various arithmetic operations to comprehensively control the entire printing apparatus 100. More specifically, for example, the CPU 101 executes processing such as print control, conveyance control, and storage control. The ROM 102 stores various control programs executed by the CPU 101 and fixed data. The RAM 103 is used as a work area when the CPU 101 executes various arithmetic operations or various kinds of control processing.

Further, a communication interface (I/F) 105 for acquiring print image data from an external apparatus and a memory card I/F 106 for acquiring image data from an external storage device, represented by a memory card or the like, are connected to the system bus 104. Further, an operation I/F 107 for providing information to a user and inputting or outputting an operation is connected to the system bus 104.

Furthermore, various sensors such as a conveyance sensor 108 for detecting a sheet conveyance state, a position sensor 109 (as an example of a detection device) for detecting the position of a recording medium in the direction orthogonal to the conveyance direction thereof, and a stacking mechanism sensor 110 for detecting the opening and closing state of a stacking mechanism are connected to the system bus 104. In the present exemplary embodiment, the conveyance direction of a sheet is referred to as the first direction, whereas the direction orthogonal to the conveyance direction is referred to as the second direction. As described below, the second direction corresponds to the moving direction of a carriage provided on a printing device 113, so that the second direction is also referred to as the main scanning direction.

Figure 2:
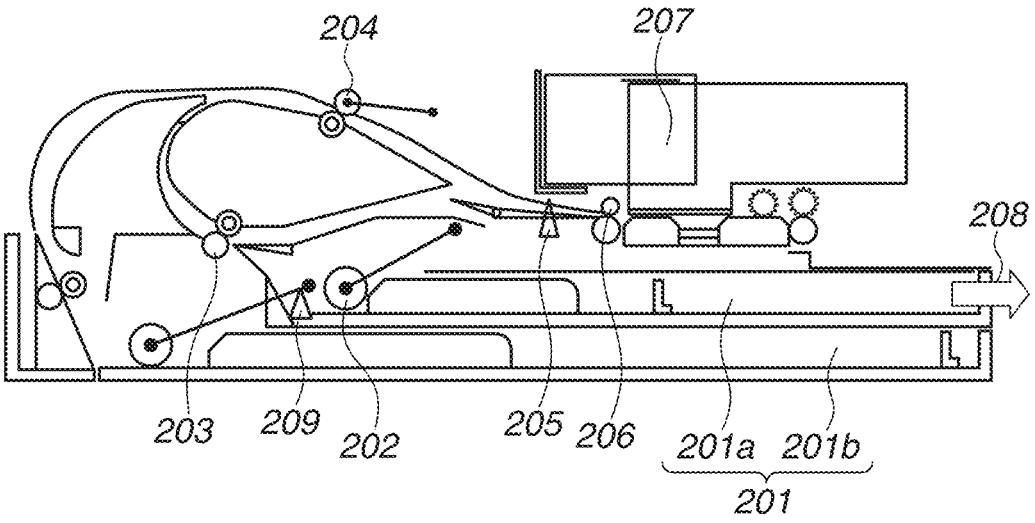
FIG. 2 is a cross-sectional view illustrating a conveyance path in a mechanism unit of the printing apparatus according to the first exemplary embodiment.

Further, a sheet feeding device 111 arranged in the conveyance path of the printing apparatus 100, a sheet conveyance device 112 arranged in the vicinity of the printing device 113, and the printing device 113 for executing printing on a conveyed sheet are also connected to the system bus 104. For example, the sheet feeding device 111 corresponds to a first intermediate conveyance roller 203 and a second intermediate conveyance roller 204 (see FIG. 2) to be described below, whereas the sheet conveyance device 112 corresponds to a conveyance roller 206 (see FIG. 2) to be described below. FIG. 2 is a cross-sectional view illustrating a conveyance path in a mechanism unit of the printing apparatus 100 according to the present exemplary embodiment.

The printing apparatus 100 according to the present exemplary embodiment includes a stacking mechanism 201 for stacking sheets. The stacking mechanism 201 according to the present exemplary embodiment serves as a sheet feeding unit, and includes two sheet feeding cassettes 201*a* (as an example of a first feeding source) and 201*b* (as an example of a second feeding source). When a user performs an operation to pull out the stacking mechanism 201 (moves the stacking mechanism 201 in the direction indicated by an arrow 208 illustrated in FIG. 2) to supply sheets thereto, a stacking mechanism sensor 209 can detect that the stacking mechanism 201 is opened and closed. The CPU 101 can identify whether print sheets are supplied thereto by storing the detection result.

The sheets stacked on the sheet feeding cassette 201*a* or 201*b* are conveyed one by one into the printing apparatus 100 by a pick-up roller 202.

The sheets fed from the sheet feeding cassette 201*a* or 201*b* are sequentially conveyed by the first intermediate conveyance roller 203 and the second intermediate conveyance roller 204 inside the printing apparatus 100, so that a conveyance sensor 205 can detect the conveyed position of a recording medium in the conveyance direction thereof. The conveyance sensor 205 corresponds to the conveyance sensor 108 illustrated in FIG. 1. By continuously operating the above-described first and second intermediate conveyance rollers 203 and 204, the sheet is conveyed to the conveyance roller 206. Then, the conveyance roller 206 conveys the sheet to a position immediately below a printing device 207, where printing can be executed.

Figure 3:
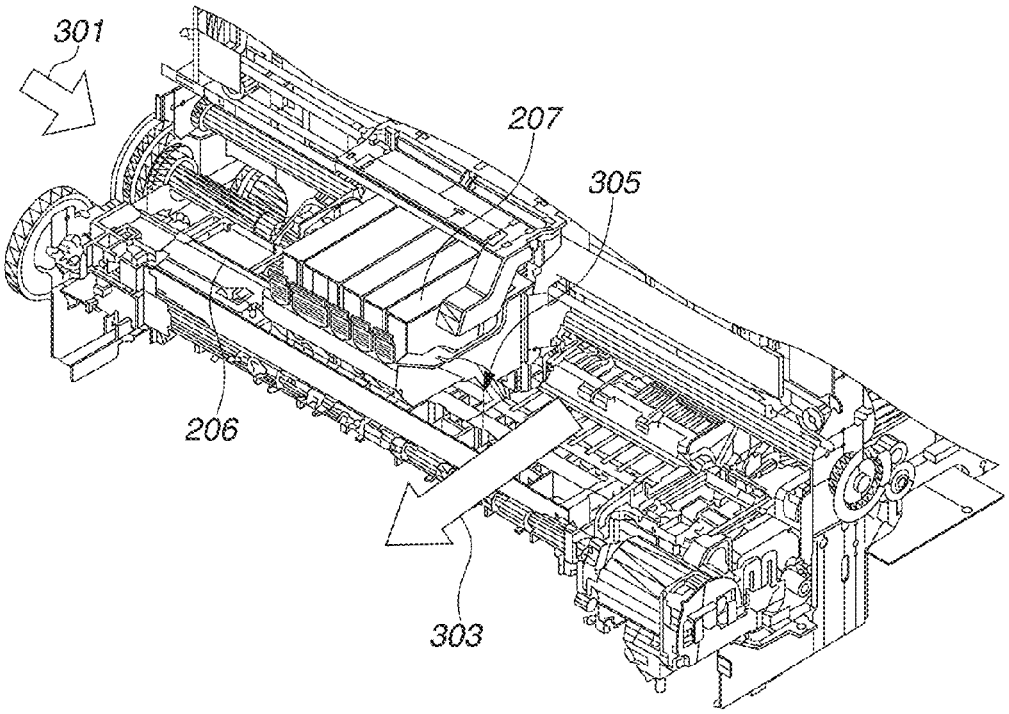
FIG. 3 is an enlarged perspective view of an operation unit of a printing device in the printing apparatus according to the first exemplary embodiment.

FIG. 3 is an enlarged perspective view of an operation unit of the printing device 207 illustrated in FIG. 2. FIG. 2 is a cross-sectional view seen from the direction indicated by an arrow 301 illustrated in FIG. 3.

In FIG. 3, the conveyance roller 206 conveys the sheet in the conveyance direction indicated by an arrow 303.

The printing device 207 illustrated in FIG. 3 is a so-called printing unit and corresponds to the printing device 113. The printing device 207 executes printing by forming an image on paper (a sheet) conveyed thereto. The printing device 207 is provided with a head unit on which a plurality of ink jet print heads is disposed, a carriage on which the head unit is mounted, and a guide rail. The carriage is operated along the guide rail by a carriage motor (not illustrated) in the direction (i.e., the main scanning direction of the carriage) orthogonal to the conveyance direction 303 to execute a print operation. A drive pulse is applied to the print heads, so that an image based on image data is formed on a sheet.

A position sensor 305 for detecting the position of a recording medium in the main scanning direction is arranged in the vicinity of the printing device 207, so that a displacement, in the main scanning direction (i.e., the second direction), of the sheet conveyed by the conveyance roller 206 is detected by the position sensor 305. The position sensor 305 illustrated in FIG. 3 corresponds to the position sensor 109 illustrated in FIG. 1.

Figure 4A:
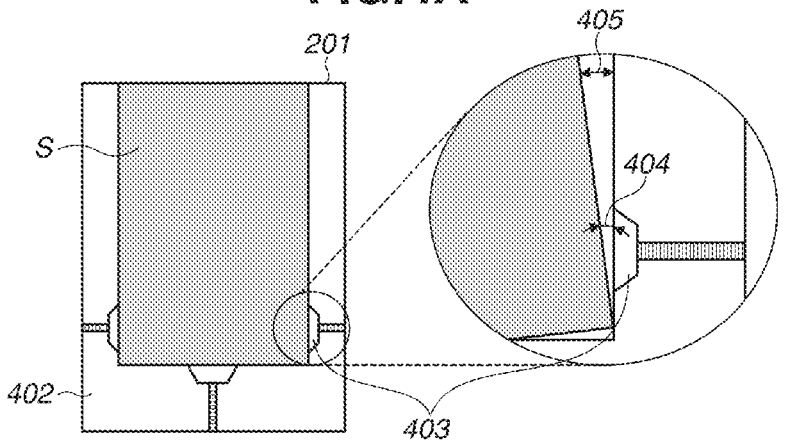
FIGS. 4A, 4B, and 4C illustrate a displacement of a sheet during conveyance, which occurs in a direction orthogonal to a sheet conveyance direction of the printing apparatus according to the first exemplary embodiment.
Figure 4B:
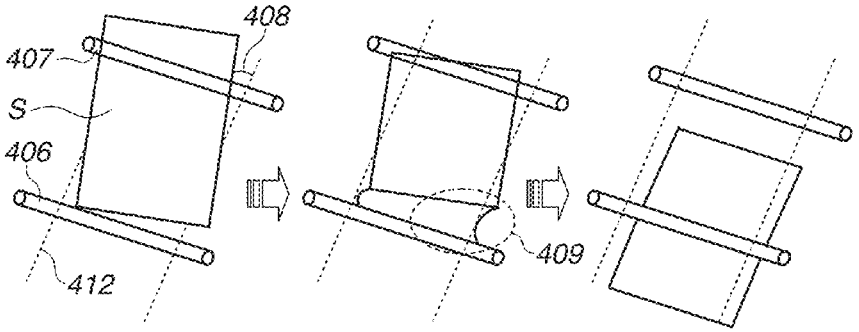
Figure 4C:
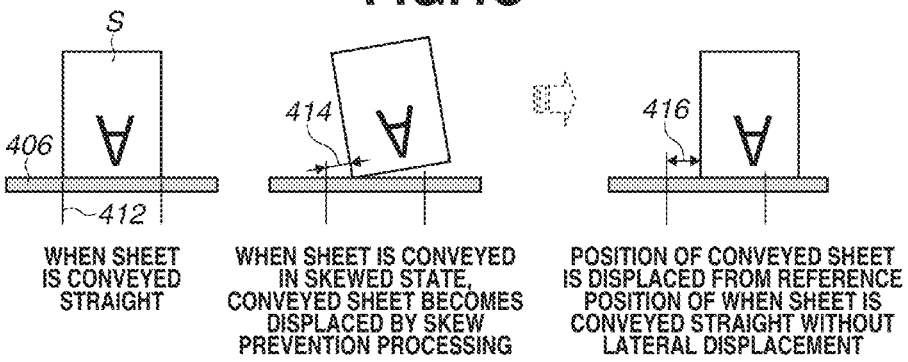

The operation start position of the printing device 207 in the main scanning direction is determined based on the sheet position detected by the position sensor 305. FIGS. 4A, 4B, and 4C illustrate a displacement of a sheet during conveyance, which occurs in the direction (main scanning direction) orthogonal to the conveyance direction. A displacement of a sheet during conveyance may be caused by the stacking of the sheet or caused while the sheet is being conveyed. FIG. 4A illustrates the state where a print sheet is stacked on the sheet stacking mechanism 201 for stacking print sheets. A sheet S stacked on the stacking mechanism 201 is supported by a stacking lever 402 for holding the sheet S in the lengthwise direction thereof and a stacking lever 403 for holding the sheet S in the width direction thereof. Sheets S in different sizes can be stacked on the stacking mechanism 201 by changing the fixing positions of these two stacking levers 402 and 403. When a gap 404 is created between the stacking lever 403 in a fixed state and the sheet S, the sheet S cannot be stacked while being straight with respect to the stacking mechanism 201, and the sheet S is thus stacked while being displaced in a skew direction. At this time, the angle of the sheet S in the direction orthogonal to the conveyance direction is referred to as an angle 405. This is the state where the stacked sheet S is skewed inside the stacking mechanism 201.

Herein, with reference to FIGS. 4B and 4C, a description will be given of correcting a skew of the sheet S being conveyed, which is executed when the sheet S has been conveyed in a skew direction with respect to the expected conveyance direction (hereinafter, also referred to as "reference conveyance direction"). FIG. 4B conceptually illustrates the state where a skew prevention operation is executed on the sheet S that is skewed due to stacking performance. FIG. 4C illustrates a displacement of the sheet S during conveyance.

As illustrated in FIG. 4B, both of a first conveyance roller 406, and a second conveyance roller 407 located on the upstream side of the first conveyance roller 406 in the conveyance path are provided on the conveyance path to convey the sheet S along the conveyance path.

Herein, a description will be given of an example of the skew prevention operation that is executed when the sheet S is conveyed in a skewed state at an angle 408 with respect to the conveyance path.

When the conveyance roller 407 keeps conveying the sheet S and the conveyance roller 406 remains in a stopped state, the sheet S hits against the conveyance roller 406, and a loop 409 is generated at the position where the sheet S hits against the conveyance roller 406. In such a state, by the time the sheet S passes through the conveyance roller 407, which is arranged on the upstream side of the conveyance roller 406 in the conveyance path, the conveyance roller 406 starts conveying the sheet S to eliminate the loop 409 generated on the sheet S.

As a result of the skew prevention operation, the sheet S skewed with respect to the conveyance path is placed in a position along the conveyance path, bringing the sheet S to a state where the skew is corrected.

FIG. 4C is a top plan view illustrating a behavior of the sheet S, which is skewed with respect to the conveyance path, during the skew prevention operation. The left of FIG. 4C illustrates the state where the sheet S is conveyed straight, i.e., the sheet S is conveyed in the direction (reference conveyance direction) orthogonal to the conveyance roller 406, and thus the edge portion of the sheet S matches a reference position 412.

On the contrary, as described above, in a case where the sheet S is conveyed while being skewed with respect to the conveyance path, the sheet S obliquely makes contact with the conveyance roller 406, so that a skew displacement amount 414 is generated. After the skew prevention operation, the skew of the sheet S is corrected so that the sheet S is straight with respect to the conveyance path. Herein, the skew prevention operation refers to the operation for adjusting the position of the skewed sheet S to the position orthogonal to the conveyance roller 406. In the present exemplary embodiment, the skew prevention operation is executed, for example, in an area between the second intermediate conveyance roller 204 and the conveyance roller 206 positioned at the end of the conveyance path. A method for executing the skew prevention operation is not particularly limited, and the skew prevention operation is executed, for example, with a known method described in Japanese Patent Publication No. 62-38261.

By executing the skew prevention operation, the tilt of the sheet S with respect to the reference conveyance direction is corrected, so that the sheet S is positioned along the reference conveyance direction. However, compared to the case where the sheet S is conveyed in the reference conveyance direction without a skew, the position of the sheet S in the direction orthogonal to the reference conveyance direction is displaced. In other words, the sheet S results in being located in a position displaced from the reference position 412 by a predetermined displacement amount 416. As illustrated in FIG. 4C, the skew is corrected by using a portion being in contact with the conveyance roller 406 as a fulcrum. Therefore, the displacement amount of the sheet S in the direction orthogonal to the reference conveyance direction when the sheet S makes contact with the conveyance roller 406 is the displacement amount 416 after the skew prevention operation.

Figure 5A:
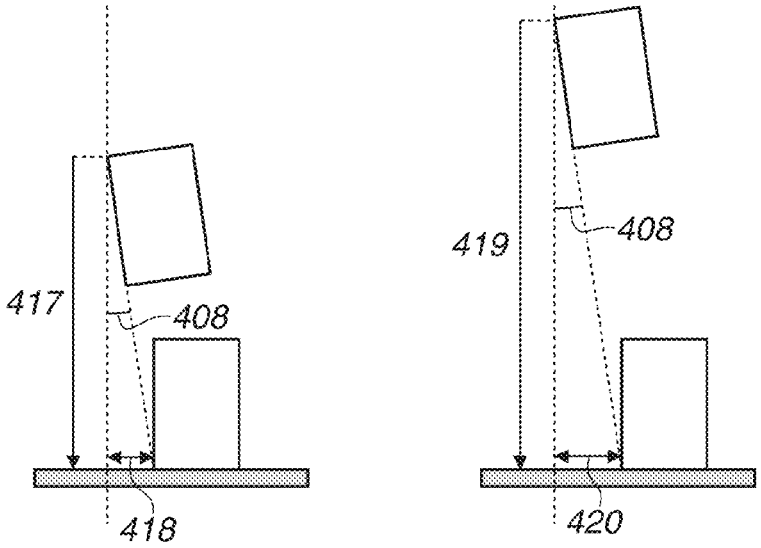
FIG. 5A illustrates a displacement of a sheet during conveyance, which occurs in the direction orthogonal to the sheet conveyance direction of the printing apparatus according to the first exemplary embodiment.

FIG. 5A illustrates a relationship between a conveyance distance of the skewed sheet S and a displacement amount.

In the case of a conveyance distance 417, when the sheet S is conveyed in a skew direction at an angle 408, a displacement amount after the skew prevention operation is a displacement amount 418. On the other hand, in the case of a conveyance distance 419 longer than the conveyance distance 417, when the sheet S is conveyed in the skew direction at the same angle 408, a displacement amount after the skew prevention operation is a displacement amount 420 that is greater than the displacement amount 418. As described above, the displacement amount increases as the conveyance distance becomes longer.

Figure 5B:
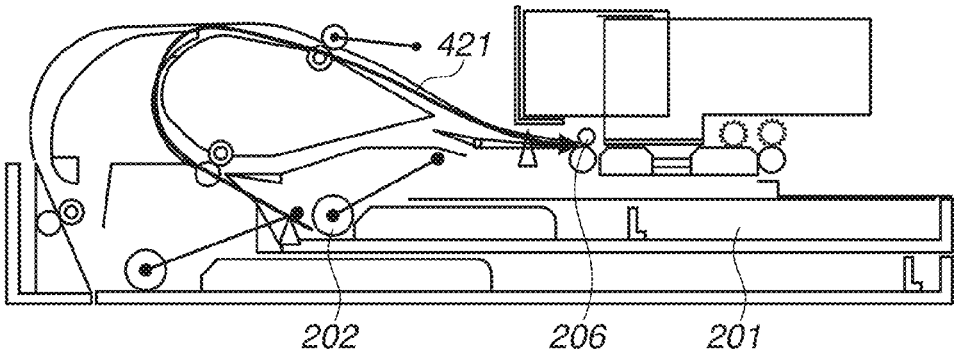
FIGS. 5B and 5C are cross-sectional views illustrating sheet conveyance paths of the printing apparatus according to the first exemplary embodiment.
Figure 5C:
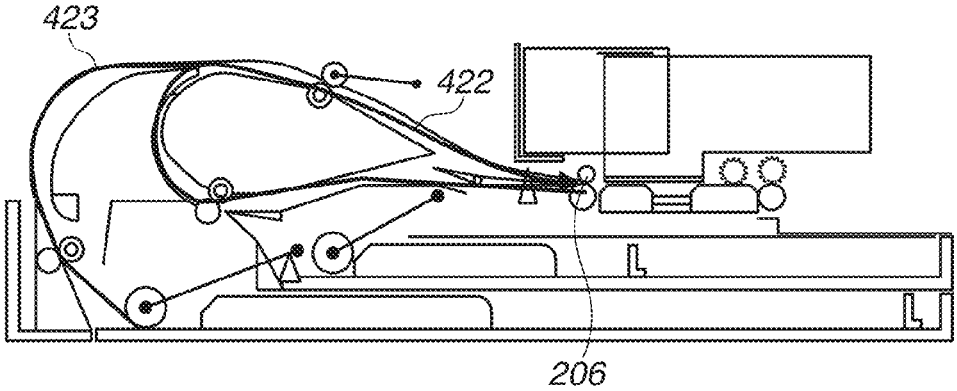

FIGS. 5B and 5C illustrate the conveyance paths in a print operation.

First, the conveyance paths for front-side printing and back-side printing in two-sided printing will be described. In the present exemplary embodiment, the front side of the sheet S is printed as the first side, whereas the back side of the sheet S is printed as the second side opposite to the first side. As illustrated in FIG. 5B, in the front-side printing, the sheet S is conveyed by the pick-up roller 202 from the stacking mechanism 201 to the conveyance roller 206 through a path 421. On the other hand, as illustrated in FIG. 5C, in the back-side printing, the sheet S is conveyed from the conveyance roller 206 to the pick-up roller 202 through a path 422 after the front-side printing is completed. As described above, the conveyance distance is longer in the back-side printing than in the front-side printing.

Further, in a case where the stacking mechanism 201 has two-stage sheet feeding cassettes, as illustrated in FIG. 5C, when the front-side printing is executed on the sheet S fed from the lower sheet feeding cassette of the stacking mechanism 201, the sheet S is conveyed by the pick-up roller 202 from the stacking mechanism 201 to the conveyance roller 206 through a path 423. Therefore, the conveyance distance thereof is longer than the path 421.

As illustrated in FIG. 4A, in a case where the sheet S is skewed with respect to the conveyance path illustrated in FIG. 4B (see the angle 408 illustrated in FIGS. 4B and 5A) due to the stacking performance at the time of stacking the sheet S on the stacking mechanism 201, the degree of the skew can be corrected by the skew prevention operation. However, as the conveyance path becomes longer, the skew displacement amount 414 illustrated in FIG. 4C increases, and accordingly the displacement amount 416 at the corrected position after the skew prevention operation also increases.

Figure 6A:
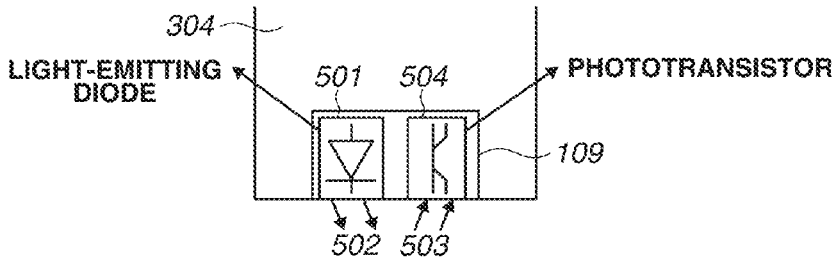
FIGS. 6A, 6B, and 6C conceptually illustrate sheet edge detection executed by the printing apparatus according to the first exemplary embodiment.
Figure 6B:
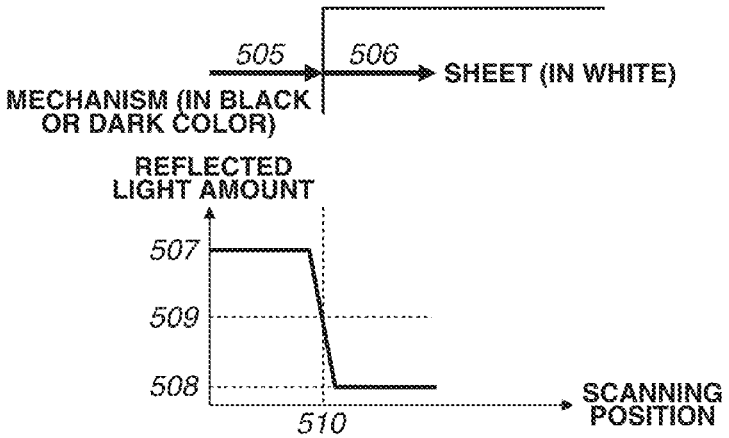
Figure 6C:
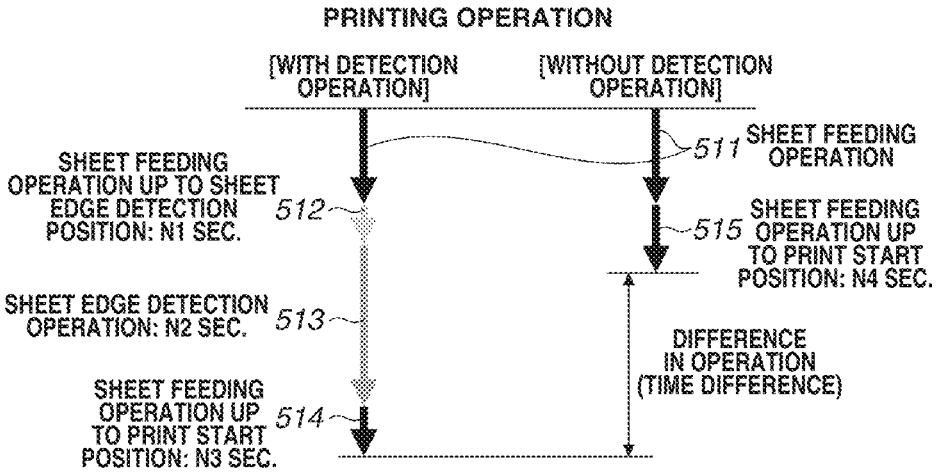

As described above, in the back-side printing, the length of the conveyance path corresponds the sum of the lengths of the conveyance path 421 for the front-side printing and the conveyance path 422 for the back-side printing. Therefore, as illustrated in FIG. 5A, a sheet displacement amount increases due to the length of the conveyance path. Further, even if the skew has been corrected during the front-side printing, the sheet S may become skewed during the conveyance. Thus, the displacement amount of the sheet S with respect to the reference position, which occurs in the direction orthogonal to the conveyance direction, is greater in the back-side printing than in the front-side printing. As described above, the degree of skew depends on the length of the conveyance path. For example, the degree of skew is greater in the back-side printing of the two-sided printing than in the front-side printing of the two-sided printing. Furthermore, the degree of skew is greater particularly when the two-sided printing is executed on the sheet fed from the lower sheet feeding cassette. Herein, sheet edge detection executed by the printing apparatus 100 according to the present exemplary embodiment will be described with reference to FIGS. 6A, 6B, and 6C. FIGS. 6A, 6B, and 6C conceptually illustrate the sheet edge detection executed by the printing apparatus 100.

FIG. 6A schematically illustrates the position sensor 109. The position sensor 109 is arranged on the printing device 207 illustrated in FIG. 3, and is configured to detect an object by reading the amount of light emitted to and reflected from the object. For example, a light emitting unit 501 for emitting light is a light-emitting element, and configured of a light-emitting diode. For example, a light receiving unit 504 is configured of a phototransistor. Light 502 emitted from the light emitting unit 501 is reflected on an obstacle (i.e., object) such as a print sheet, so that reflected light 503 is detected by the light receiving unit 504. With the above-describe configuration, the state of an edge of a print sheet serving as a light-reflecting object can be detected. The printing device 207 operates while moving in the main scanning direction, and the position sensor 109 detects the amount of light reflected on the light-reflecting object while moving in the main scanning direction.

FIG. 6B is a graph illustrating a relationship between the amount of light received by the light receiving unit 504 and the sheet edge. At a position in an area 505 outside the sheet edge, a mechanism member positioned outside the sheet serves as the light-reflecting object, whereas the sheet in white color serves as the light-reflecting object at a position in an area 506 inside the sheet edge. As described above, the amount of reflected light varies depending on the light-reflecting object. More specifically, at a position in the area 505 outside the sheet edge, the light is reflected on the mechanism member in black or dark color, so that a reflected light amount 507 is at a high level. On the other hand, a reflected light amount 508 at a position in the area 506 inside the sheet edge is at a low level.

A boundary level 509 is specified as a threshold value while considering the performance of the light emitting unit 501, the light-reflecting object, and the light receiving unit 504, and a sheet edge position 510 can be calculated by determining whether the reflected light amount is equal to or greater than the threshold value.

A difference in operation time between the print operations with and without the sheet edge detection will be described with reference to FIG. 6C. FIG. 6C illustrates an operational difference between the print operations with and without the sheet edge detection.

When the sheet edge detection operation is to be executed, the sheet is first conveyed into the sheet conveyance path of the printing apparatus 100 through a sheet feeding operation 511. Then, the sheet is fed to a sheet edge detection position through a sheet feeding operation 512 so that the sheet edge detection is executed by the position sensor 109. The time taken for the sheet feeding operation 512 is N1 seconds. Then, a sheet edge detection operation 513 is executed by the position sensor 109 to detect the edge of the conveyed sheet S. The time for the position sensor 109 to move in the main scanning direction to detect the sheet edge is N2 seconds. N2 seconds are much longer than N1 seconds, that is, the time taken for the sheet feeding operation 512. Subsequently, the time taken for a sheet feeding operation 514 for feeding the sheet S to a print start position is N3 seconds. The print operation is then executed by the printing device 113.

On the other hand, when the sheet edge detection operation is not to be executed, similarly to the case where the detection operation is executed, the sheet S is first conveyed into the sheet conveyance path of the printing apparatus 100 through a sheet feeding operation 511. Subsequently, a sheet feeding operation 515 for feeding the sheet S to the print start position takes N4 seconds. The print operation is then executed by the printing device 113. The operation time N4 seconds for the sheet feeding operation 515 for feeding the sheet S to the print start position is approximately the same as a total of the operation time N1 seconds for the sheet feeding operation 512 for feeding the sheet S to the sheet edge detection position and the operation time N3 seconds for the sheet feeding operation 514 for feeding the sheet S to the print start position.

As described above, the processing time is different between the print operation with the sheet edge detection and the print operation without the sheet edge detection. In other words, the processing time is longer if the sheet edge detection is executed.

According to the present exemplary embodiment, the frequency of executing the sheet edge detection is reduced so that the sheet edge detection is executed at appropriate timing, and thus high-speed printing with high image quality can be realized.

Figure 7:
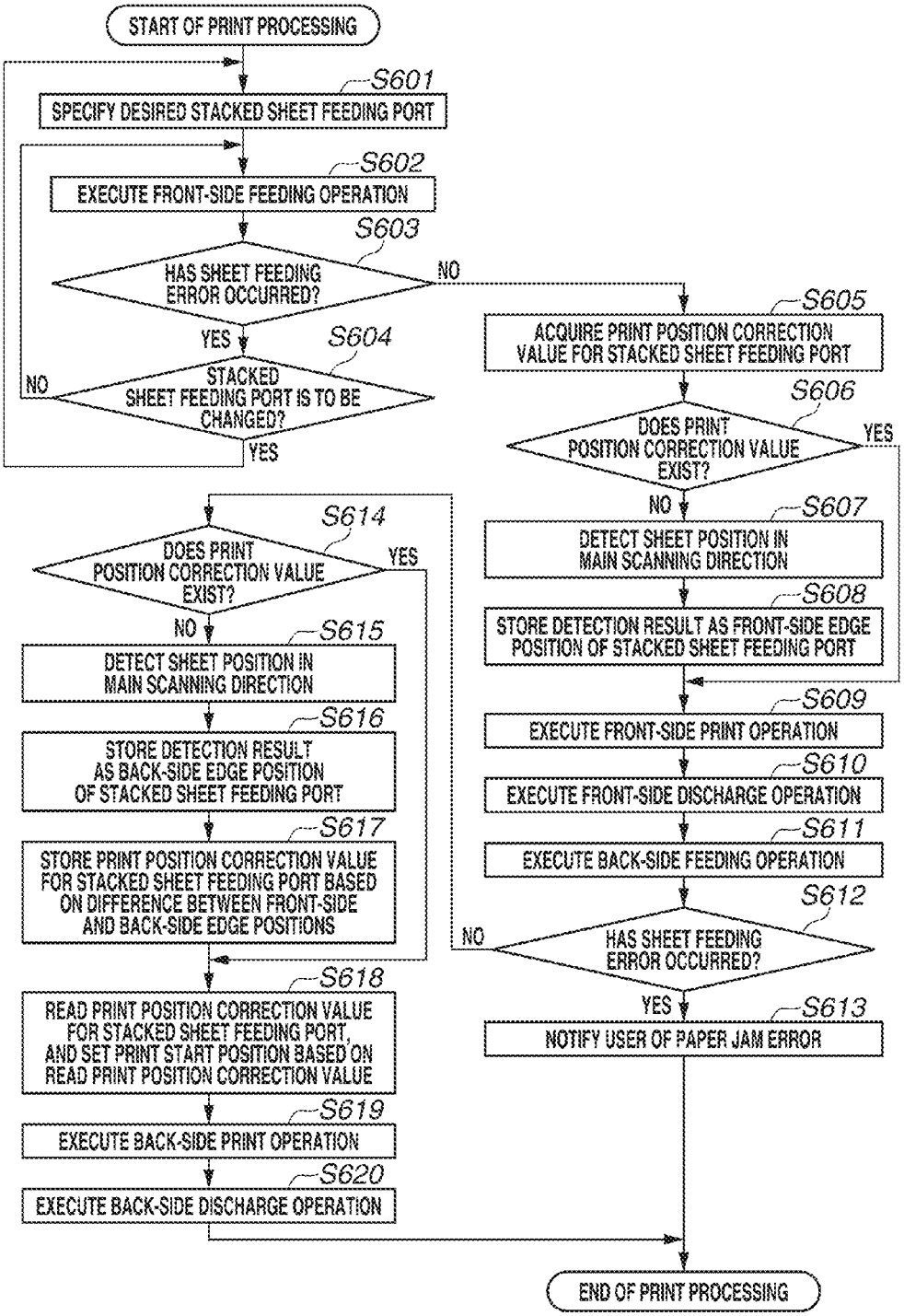
FIG. 7 is a flowchart illustrating control processing of two-sided printing executed by the printing apparatus according to the first exemplary embodiment.

FIG. 7 is a flowchart illustrating control processing of two-sided printing executed by the printing apparatus 100 according to the present exemplary embodiment. The CPU 101 loads a program stored in the ROM 102 onto the RAM 103 to execute the control processing.

A flow of control processing of a print operation in the two-sided printing will be described with reference to FIG. 7.

When the print processing is started, in step S601, a stacked sheet feeding port to be used is selected from among a plurality of stacked sheet feeding ports. In other words, a stacked sheet source from which a sheet is to be fed is specified. In order to specify the stacked sheet feeding port, the CPU 101 may receive a user's instruction via the operation I/F 107, or may receive an instruction from a program operating on a host personal computer (PC) connected to the printing apparatus 100 via the communication I/F 105.

Next, in step S602, the CPU 101 executes the front-side feeding operation. Then, in step S603, the CPU 101 determines whether a sheet feeding error has occurred. In other words, in step S603, the CPU 101 checks whether a sheet has been successfully fed.

If a sheet feeding error has occurred (YES in step S603), the processing proceeds to step S604. In step S604, the CPU 101 determines whether to change the stacked sheet feeding port from which a sheet is to be fed. In order to change the sheet feeding port, the CPU 101 may receive a user's instruction via the operation I/F 107, or may receive an instruction from a program operating on a host PC connected to the printing apparatus 100 via the communication I/F 105. If the CPU 101 receives an instruction for changing the stacked sheet feeding port within a predetermined period, the CPU 101 determines that the stacked sheet feeding port is to be changed.

If the stacked sheet feeding port is not to be changed (NO in step S604), the processing returns to step S602 and the front-side feeding operation is executed again. If the stacked sheet feeding port is to be changed (YES in step S604), the processing returns to step S601 and a desired stacked sheet feeding port is specified again.

If a sheet feeding error has not occurred (NO in step S603), the processing proceeds to step S605. In step S605, the CPU 101 acquires predetermined correction values from a storage unit as the print position correction values for the stacked sheet feeding ports.

After acquiring the print position correction values for the stacked sheet feeding ports, then in step S606, the CPU 101 determines whether the print position correction value exists. Herein, the print position correction value is set for each of the stacked sheet feeding ports, and the CPU 101 determines whether the print position correction value for the stacked sheet feeding port specified in step S601 exists. The print position correction value is the value for correcting the positional displacement that is obtained based on a front-side edge position value and a back-side edge position value in the last or earlier operation. A method for acquiring the front-side edge position value and the back-side edge position value will be described below.

If the print position correction value exists (YES in step S606), the processing proceeds to step S609 without executing the sheet edge position detection in the main scanning direction in step S607.

If the print position correction value does not exist (NO in step S606), the processing proceeds to step S607. In step S607, the CPU 101 detects a sheet edge position in the main scanning direction by using the position sensor 109 described with reference to FIGS. 6A, 6B, and 6C. In step S608, the CPU 101 stores the detection result as the front-side edge position of the stacked sheet feeding port. Then, the processing proceeds to step S609.

Herein, presence or absence of the print position correction value will be described. In the present exemplary embodiment, when the user opens the stacking mechanism 201 (i.e., sheet feeding unit) or powers off the printing apparatus 100, the print position correction value for the stacked sheet feeding port is set as "NONE". Herein, the wording "setting the print position correction value to NONE" is synonymous with "deleting the print position correction value stored in the storage unit". When the opening and closing of the stacking mechanism 201 is detected (in the present exemplary embodiment, when the operation for pulling out the stacking mechanism 201 is detected), the print position correction value is set as "NONE". This is because a positional displacement of a print sheet may occur in the stacking mechanism 201 when the sheet is stacked thereon, and it is desirable to detect the sheet edge position again. Further, in the present exemplary embodiment, the stacking mechanism 201 cannot be monitored in a power-off mode, so that stacked sheets cannot be checked even though the sheets have been newly stacked on the stacking mechanism 201. Therefore, the print position correction value is set as "NONE" when the printing apparatus 100 is powered off. At this time, the print position correction values for all the stacked sheet feeding ports serving as the correction targets are set as the initial value "NONE". With this configuration, when the printing apparatus 100 is powered off and powered on again, and then the first sheet immediately after the power-on is to be printed, the edge position of the sheet in the direction orthogonal to the conveyance direction is detected. In the present exemplary embodiment, all the stacked sheet feeding ports (i.e., sheet feeding cassettes 201*a* and 201*b*) serve as the correction targets. However, a specific stacked sheet feeding port (e.g., sheet feeding cassette 201*a*) may serve as the correction target.

In step S609, the CPU 101 executes the front-side printing operation. In step S610, the CPU 101 executes the front-side discharge operation to prepare for the back-side print operation. In step S611, the CPU 101 executes the back-side feeding operation. By executing the back-side feeding operation, the print sheet is conveyed through the conveyance path 422 illustrated in FIG. 5C.

Next, in step S612, the CPU 101 determines whether a sheet feeding error has occurred due to the execution of the back-side feeding operation.

If a sheet feeding error has occurred in the back-side feeding operation (YES in step S612), the processing proceeds to step S613. In step S613, the CPU 101 notifies the user of a paper jam error and the print processing ends. The CPU 101 may notify the user of the error by displaying a message on a display device (not illustrated) such as a liquid crystal panel provided on the outer surface of the printing apparatus 100, by lighting up a display unit with a light-emitting diode (LED) provided on the outer surface of the printing apparatus 100, or by outputting an audio message. In the present exemplary embodiment, the paper jam error is taken as an example of a sheet feeding error occurring in the back-side feeding operation. However, the error is not limited thereto.

If a sheet feeding error has not occurred (NO in step S612), the processing proceeds to step S614. In step S614, the CPU 101 determines whether the print position correction value exists. The above-described determination processing is similar to the determination processing executed in the front-side print operation.

If the print position correction value exists (YES in step S614), the processing proceeds to step S618. In step S618, since the print position correction value for the stacked sheet feeding port has already been stored, the CPU 101 reads the stored print position correction value for the stacked sheet feeding port and sets the print start position based on the read print position correction value.

If the print position correction value does not exist (NO in step S614), the processing proceeds to step S615. In step S615, the CPU 101 detects a sheet edge position in the main scanning direction. Then, in step S616, the CPU 101 stores the detection result as the back-side edge position of the stacked sheet feeding port. Then, in step S617, based on the difference between the front-side edge position stored in step S608 and the back-side edge position stored in step S616, the CPU 101 determines the print position correction value for the stacked sheet feeding port. More specifically, the front-side edge position stored in step S608 is set as the reference position, and the print position correction value for the stacked sheet feeding port is calculated based on a difference between the reference position and the back-side edge position stored in step S616. Then, the calculated print position correction value is stored as the print position correction value for the sheet stacking feeding port specified in step S601. The print position correction value derived from the front-side detection result and the back-side detection result will be described below. Then, in step S618, the CPU 101 reads the print position correction value for the stacked sheet feeding port stored in step S617 and sets the print start position based on the read print position correction value.

In step S619, the CPU 101 executes the back-side print operation based on the back-side print start position set in step S618. Then, in step S620, the CPU 101 executes the back-side discharge operation of the sheet, so that the print processing is completed. As described above, in the present exemplary embodiment, the print start position is corrected when the back-side print operation of the two-sided printing is executed. Sheet edge detection for this correction is executed, if the user opens the stacking mechanism 201 or powers off the printing apparatus 100, during the subsequent print operation.

Figure 8A:
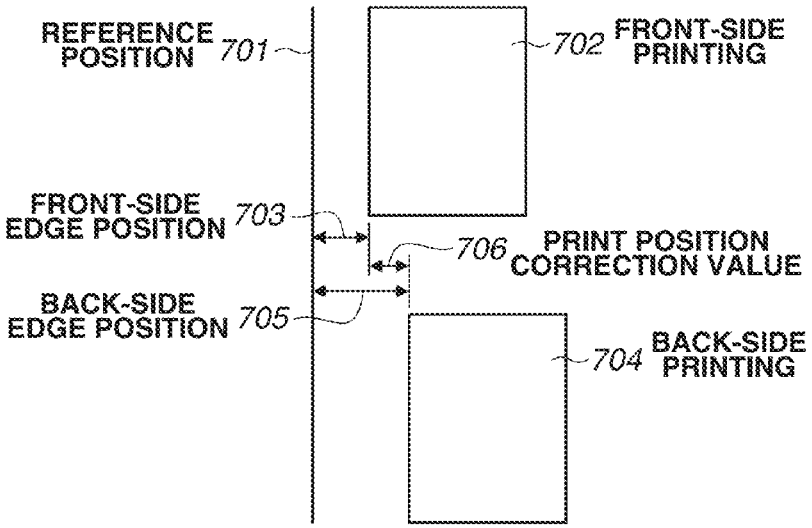
FIGS. 8A and 8B illustrate a print position correction executed by the printing apparatus according to the first exemplary embodiment.
Figure 8B:
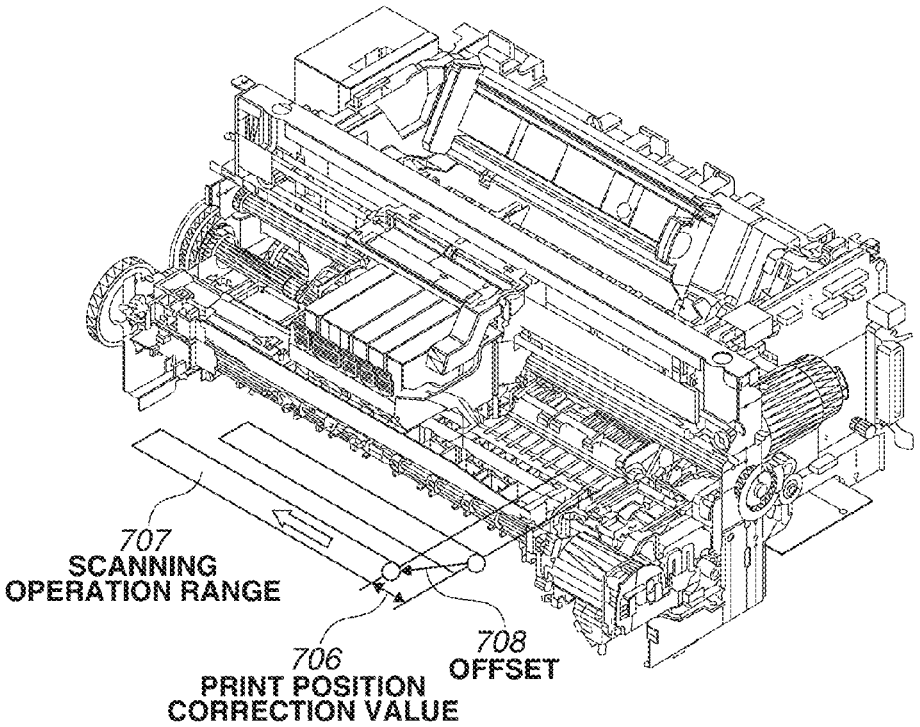

The back-side print start position will be described with reference to FIGS. 8A and 8B. FIGS. 8A and 8B illustrate the print position correction executed by the printing apparatus 100 according to the present exemplary embodiment. As illustrated in FIGS. 8A and 8B, in a case where a front-side edge position 703 is displaced with respect to a reference position 701 of a print position in the printing apparatus 100, a sheet edge in front-side printing 702, i.e., the front-side edge position 703 can be derived from the detection of the sheet edge position in the main scanning direction executed in step S607 illustrated in FIG. 7. Then, in step S608, the derived position is stored as the front-side edge position of the stacked sheet feeding port.

Because of the structure of the mechanism unit, the above-described reference position 701 may be defined as a leftmost edge, or may be defined based on the specifications of the printing apparatus 100.

A sheet edge in the back-side printing 704, i.e., a back-side edge position 705 can be derived from the detection of the sheet edge position in the main scanning direction executed in step S615 illustrated in FIG. 7. Then, in step S616, the derived position is stored as the back-side edge position of the stacked sheet feeding port.

A difference between the front-side edge position 703 and the back-side edge position 705 is a print position correction value 706.

Based on the print position correction value 706, as illustrated in FIG. 8B, the start position of a scanning operation range 707 is moved by an offset 708 to start the print operation. With this operation, the back-side print position can be adjusted to the front-side print position.

In the present exemplary embodiment, when printing is executed on a plurality of sheets, the control processing of the two-sided printing illustrated in FIG. 7 is executed on a sheet-by-sheet basis. Because the print position correction value for the stacked sheet feeding port has been stored during the print operation of the first sheet, when printing of the second and subsequent sheets is to be executed, both the determination results in steps S606 and S614 are "YES" unless the stacked sheet feeding port has been changed, and thus the detection of the sheet edge position is not executed. In other words, according to the present exemplary embodiment, the detection of the sheet edge position is executed when the printing is executed on the first sheet after powering on the printing apparatus 100, the first sheet after opening the stacking mechanism 201, or the first sheet after changing the stacked sheet feeding port.

As described above, the detection of the sheet edge position in the main scanning direction for the second and subsequent sheets is executed only when a specific condition is satisfied. This can shorten the initial print operation for detecting the sheet edge position. In other words, in a case where printing is executed on a plurality of sheets, the print operation can be shortened because the time taken to detect the sheet edge position in the main scanning direction is reduced, compared to the case where the detection is executed on a sheet-by-sheet basis. Further, even when printing is to be executed on the second or the subsequent sheet, the detection of the sheet edge position is executed if a specific condition is satisfied. This can maintain high image quality. According to the present exemplary embodiment, a displacement of a sheet in the main scanning direction due to the stacking of the sheet on the stacking mechanism 201 can be corrected. It is therefore possible to prevent a displacement of the print start position that is caused by the displacement of the sheet in the main scanning direction due to the stacking of the sheet on the stacking mechanism 201, and thereby maintain high image quality.

In the present exemplary embodiment, if the user opens the stacking mechanism 201, the print position correction value is updated to the initial value "NONE", and the detection of the sheet edge position in the main scanning direction is executed in the subsequent print operation. Similarly, if the user powers off the printing apparatus 100, the print position correction value is updated to the initial value "NONE", and the detection of the sheet edge position in the main scanning direction is executed in the subsequent print operation. With the above-described configuration, if the user opens the stacking mechanism 201 or powers off the printing apparatus 100, it is possible to prevent a displacement of the print start position, thereby maintaining high image quality.

Further, according to the present exemplary embodiment, the stored print position correction value is used unless printing of the first sheet is to be executed or a specific condition is satisfied. It is therefore possible to realize higher-speed printing while maintaining high image quality.

According to the present exemplary embodiment, in the case of two-sided printing, a difference between the front-side edge position and the back-side edge position (i.e., a relative position) is managed, and only the back-side print start position is corrected. On the other hand, in the case of one-sided printing, the detection of the sheet edge position in the main scanning direction is not executed and the print start position is not corrected. With this configuration, printing can be executed at a higher speed in the one-sided printing.

As described above, according to the present exemplary embodiment, it is possible to prevent a displacement of a print start position in the direction orthogonal to the conveyance direction of a recording medium, while realizing high-speed printing.

Hereinafter, a second exemplary embodiment will be described. In the first exemplary embodiment, the sheet edge position is detected when printing is to be executed on the first sheet after powering on the printing apparatus 100, the first sheet after changing the sheet feeding port, or the first sheet after opening the stacking mechanism 201. In addition to the above cases, in the present exemplary embodiment, the sheet edge position is detected when printing is to be executed on the first sheet of each job. The processing steps similar to those in the first exemplary embodiment are denoted by the same reference numbers, and the description thereof will be omitted.

Figure 9A:
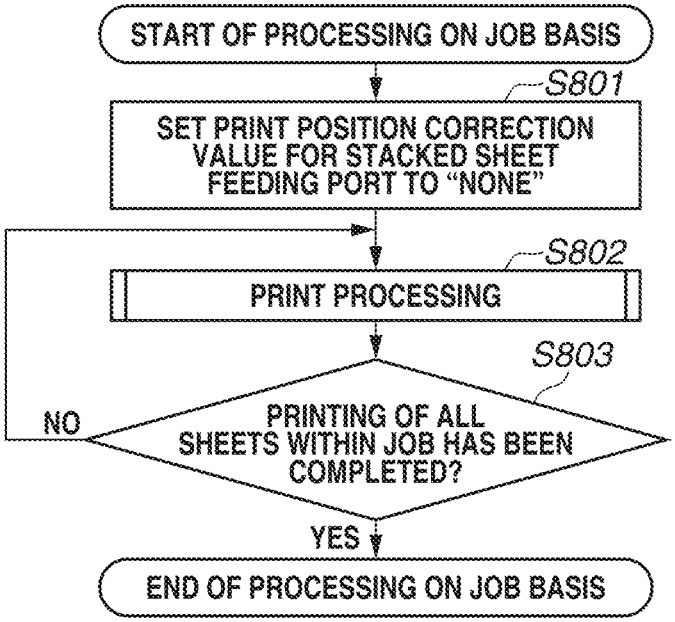

FIGS. 9A and 9B are flowcharts illustrating control processing of two-sided printing executed by the printing apparatus 100 according to the present exemplary embodiment. The CPU 101 loads a program stored in the ROM 102 onto the RAM 103 to execute the control processing.

In the present exemplary embodiment, when printing is to be executed on the first sheet of a job, the sheet edge position in the main scanning direction is detected by the position sensor 109 to correct the print start position. As illustrated in FIG. 9A, when a job is started, then in step S801, the print position correction value for the stacked sheet feeding port is set to the initial value "NONE". At this time, the print position correction values for all the stacked sheet feeding ports serving as the correction targets are set to the initial value "NONE". In the present exemplary embodiment, a specific stacked sheet feeding port (e.g., sheet feeding cassette 201*b*) serves as the correction target. However, all the stacked sheet feeding ports (i.e., sheet feeding cassettes 201*a* and 201*b*) may serve as the correction targets.

Then, in step S802, the CPU 101 executes the print processing illustrated in FIG. 9B (described below). When the print processing of the first sheet is completed, the processing proceeds to step S803. In step S803, the CPU 101 determines whether printing of all the sheets within the job has been completed. If the printing has not been completed (NO in step S803), the processing returns to step S802. If the printing has been competed (YES in step S803), the CPU 101 ends the processing for that job. In other words, the CPU 101 executes the print processing of step S802 until two-sided printing of all the sheets is completed. In addition, in the present exemplary embodiment, the print position correction value for the stacked sheet feeding port is set as "NONE" if the user opens the sheet stacking mechanism (i.e., sheet feeding unit) or powers off the printing apparatus 100.

The print processing illustrated in FIG. 9B will be described. Processing in steps S804 to S807 is similar to the processing in steps S601 to S604, and thus the description thereof will be omitted.

If a sheet feeding error has not occurred (NO in step S806), the processing proceeds to step S808. In step S808, the CPU 101 determines whether the sheet is fed from the lower stacked sheet feeding port (i.e., sheet feeding cassette 201*b*).

If the sheet is not fed from the lower stacked sheet feeding port (NO in step S808), the CPU 101 advances the processing to step S809 to execute printing without executing detection of the sheet edge and correction of the print start position. More specifically, in step S809, the CPU 101 executes front-side printing of the fed sheet, and in step S810, the CPU 101 executes the front-side discharge operation of the sheet. Then, in step S811, the CPU 101 executes the back-side feeding operation of the sheet. Subsequently, in step S812, the CPU 101 determines whether a sheet feeding error has occurred. If a sheet feeding error has occurred (YES in step S812), the processing proceeds to step S823. In step S823, the CPU 101 notifies the user of a paper jam error, and the processing ends. Because the processing regarding the paper jam error is similar to the processing of step S613, the detailed description thereof will be omitted. If a sheet feeding error has not occurred (NO in step S812), the processing proceeds to step S813. In step S813, the CPU 101 executes the back-side print operation. In step S814, the CPU 101 executes the back-side discharge operation of the sheet, and the processing ends.

If the sheet is fed from the lower stacked sheet feeding port (YES in step S808), the processing proceeds to step S815. In step S815, the CPU 101 acquires the print position correction value for the lower stacked sheet feeding port from the storage unit. Then, the processing proceeds to step S816. Processing in steps S816 to S830 is similar to the processing in steps S606 to S620, and thus the description thereof will be omitted.

In the present exemplary embodiment, the print position correction value for the stacked sheet stacking feeding port has been stored in the storage unit during printing on the first sheet. Therefore, when printing of the second and subsequent sheets of a job is to be executed, the CPU 101 determines in steps S816 and S824 that the print position correction value exists. Accordingly, the detection of the sheet edge position in the main scanning direction is not executed on the second and the subsequent sheets.

In other words, according to the present exemplary embodiment, in a case where a sheet is fed from the lower stacked sheet feeding port, the sheet edge position is detected when printing is to be executed on the first sheet after powering on the printing apparatus 100, the first sheet after opening the stacking mechanism 201, or the first sheet after changing the stacked sheet feeding port, and the first sheet of a job.

As described above, the detection of the sheet edge position in the main scanning direction is executed for the second and subsequent sheets in a job only when a specific condition is satisfied. Therefore, it is possible to shorten the initial print operation for detecting the sheet edge position. In other words, in a case where a plurality of sheets is to be printed in one job, the print operation can be shortened because the time taken to detect the sheet edge position in the main scanning direction is reduced, compared to the case where the detection is executed on a sheet-by-sheet basis. Further, because the correction is executed on a job-by-job basis, it is possible to maintain high image quality. Similarly to the first exemplary embodiment, the detection of the sheet edge position is also executed on the second or the subsequent sheet when a specific condition is satisfied. Therefore, it is possible to maintain high image quality. In the present exemplary embodiment, the displacement of a sheet in the main scanning direction due to the stacking of the sheet on the stacking mechanism 201 can be corrected. It is therefore possible to prevent a displacement of the print start position that is caused by the displacement of the sheet in the main scanning direction due to the stacking of the sheet on the stacking mechanism 201, thereby maintaining high image quality.

Furthermore, in the present exemplary embodiment, detection of the sheet edge position in the main scanning direction is not executed when a sheet is fed from the upper stacked sheet feeding port having a relatively short conveyance distance, and the detection is executed when a sheet is fed from the lower stacked sheet feeding port having a long conveyance path. Thus, detection of the sheet edge position is executed to correct the print start position in a case where a displacement of the print start position is more likely to occur. Therefore, it is possible to realize higher-speed printing while maintaining high image quality.

Further, as described above, the stored print position correction value can be used unless a specific condition is satisfied. Therefore, it is possible to realize high-speed printing while maintaining high image quality.

According to the present exemplary embodiment, similarly to the first exemplary embodiment, in the case of the two-sided printing, a difference between the front-side edge position and the back-side edge position (i.e., a relative position) is managed, and only the back-side print start position is corrected. On the other hand, in the case of the one-sided printing, the detection of the sheet edge position in the main scanning direction is not executed and the print start position is not corrected. With this configuration, printing can be executed at a higher speed in the one-sided printing.

As described above, according to the present exemplary embodiment, it is possible to prevent a displacement of a print start position in the direction orthogonal to the conveyance direction of a recording medium, while realizing high speed printing.

The present invention is not limited to the above-described exemplary embodiments. For example, in the above-described exemplary embodiments, when the stacked sheet feeding port is changed, a sheet edge position is detected and the print position correction value is determined. However, the present invention is not limited thereto. For example, the configuration may be such that, when a sheet is fed from the stacked sheet feeding port having a short conveyance distance (e.g., upper sheet feeding cassette), detection of the sheet edge position and correction of the print start position is not executed. In this case, when a sheet is fed from the stacked sheet feeding port having a long conveyance distance (e.g., lower sheet feeding cassette), the print start position is corrected by detecting the sheet edge position and determining the print position correction value. With this configuration, it is possible to realize high speed printing while maintaining high image quality.

Furthermore, in the above-described exemplary embodiments, the print start position is not corrected when the front-side printing is executed, and is corrected when the back-side printing is executed. However, the present invention is not limited thereto. For example, the print position may be corrected when the front-side printing is executed and further corrected when the back-side printing is executed. With this configuration, it is possible to obtain a printed material with higher accuracy. In a case where the print position is corrected when the front-side printing is executed, the sheet edge position may be detected, and then the print position correction value may be acquired based on a difference between the detected sheet edge position and a preset reference position.

Further, if the printing apparatus can only execute one-sided printing, the sheet edge position may be detected when printing is executed on the first sheet after powering on the printing apparatus, the first sheet after opening the stacking mechanism, or the first sheet after changing the sheet feeding port, in order to acquire the print position correction value. Also in this case, when printing is to be executed on a plurality of sheets, the print operation can be shortened because the time taken to detect the sheet edge position in the main scanning direction is reduced, compared to the case where the detection is executed on a sheet-by-sheet basis. With the above-described configuration, it is possible to realize high speed printing while maintaining high image quality. Further, in the above-described exemplary embodiments, although the printing apparatus includes a control device, the configuration thereof is not limited thereto. When control is executed by an external apparatus having a printer driver connected to the printing apparatus illustrated in FIG. 1, the external apparatus serves as the control device.

Further, the above-described exemplary embodiments of the present invention are realized by executing the following processing. Software (a program) for realizing functions of the above-described exemplary embodiments is supplied to a system or an apparatus via a network or various storage media, so that a computer (or a CPU or a micro processing unit (MPU)) of the system or the apparatus reads and executes the program. Further, the program may be executed by a single computer, or may be cooperatively executed by a plurality of computers. Further, an entire portion of the above-described processing does not need to be realized by software, and a part or an entire portion of the processing may be realized by hardware such as an application specific integrated circuit (ASIC). Furthermore, a single CPU does not need to execute an entire portion of the processing, and a plurality of CPUs may appropriately cooperate with each other to execute the processing.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-169779, filed Aug. 22, 2014, which is hereby incorporated by reference herein in its entirety.

What is claimed is:

1. A control device for a printing device having a printing unit and a plurality of feeding sources including a first feeding source and a second feeding source, the control device comprising:

a detection device configured to detect a position of a fed sheet in a direction intersecting with a conveyance direction of the sheet; and a processor configured to set a print start position in the direction intersecting with the conveyance direction based on the position of the sheet detected by the detection device, wherein the detection device does not detect the position of the sheet in a case where the sheet is fed from a first feeding source, and detects the position of the sheet in a case where the sheet is fed from a second feeding source, wherein the first feeding source and the second feeding source are included in a plurality of feeding sources that are different from each other in a distance to a printing unit.

2. A printing device comprising:

the control device of claim 1;

the printing unit; and the plurality of feeding sources, including the first feeding source and the second feeding source.

3. The printing device according to claim 2, wherein a distance from the first feeding source to the printing unit is shorter than a distance from the second feeding source to the printing unit.

4. The printing device according to claim 3, wherein each distance to the printing unit is measured along a length of a conveyance path for a sheet from a feeding source to the printing unit.

5. The printing device according to claim 4, wherein, in back-side printing, each length of the conveyance path corresponds a sum of lengths of the conveyance path for front-side printing and the conveyance path for back-side printing.

6. The printing device according to claim 2, wherein the detection device is a position sensor, the first feeding source is a first sheet feeding cassette, and the second feeding source is a second sheet feeding cassette.

7. The control device according to claim 1, wherein, in a case where printing is executed on a plurality of sheets based on image data, the detection device detects the position of the sheet when printing is to be executed on a first sheet fed from the second feeding source, and does not detect the position of the sheet when printing is to be executed on a second sheet or a subsequent sheet fed from the second feeding source.

8. The control device according to claim 1, wherein, in a case where printing is executed on a plurality of sheets based on image data, the detection device detects the position of the sheet when printing is to be executed on a first sheet, and does not detect the position when printing is to be executed on a second sheet or a subsequent sheet and, when printing is to be executed on the second sheet or the subsequent sheet and a user has opened a stacking mechanism for feeding the plurality of sheets, the detection device detects the position.

9. The control device according to claim 1, wherein, in a case where printing is executed on a plurality of sheets based on image data, the detection device detects the position when printing is to be executed on a second sheet or a subsequent sheet fed from the second feeding source and the second sheet or the subsequent sheet is a first sheet after power-off.

10. The control device according to claim 1, wherein, in a case where two-sided printing is executed on the sheet based on image data, the detection device detects a first position of a sheet in the direction intersecting with the conveyance direction when printing is to be executed on a first side of the sheet, and detects a second position of the sheet in the direction intersecting with the conveyance direction when printing is to be executed on a second side of the sheet opposite to the first side after the printing is executed on the first side, and wherein, based on the first position and the second position, the processor sets the print start position in the direction intersecting with the conveyance direction.

11. The control device according to claim 1 further comprising a print control unit configured to cause the printing unit to print an image on the sheet based on image data, wherein the print control unit causes the printing unit to print the image on the sheet based on the print start position set by the processor.

12. The control device according to claim 1 wherein the processor further is configured to specify a correction amount in the direction intersecting with the conveyance direction based on the position of the sheet detected by the detection device, wherein the processor sets the print start position based on the correction amount specified by the specification unit.

13. The control device according to claim 12 further comprising a storage control unit configured to control a storage unit to store the correction amount specified by the specification unit, wherein the processor sets the print start position based on the correction amount acquired from the storage unit.

14. The control device according to claim 13, wherein, in a case where a user opens a stacking mechanism for feeding a sheet, the storage control unit deletes the correction amount stored in the storage unit.

15. The control device according to claim 13, wherein, in a case where an apparatus including the printing unit is powered off, the storage control unit deletes the correction amount stored in the storage unit.

16. The control device according to claim 13, wherein the processor sets the print start position based on the correction amount acquired from the storage unit when printing is to be executed on a second sheet or a subsequent sheet.

17. A method for controlling a control device for a printing device having a printing unit and a plurality of feeding sources including a first feeding source and a second feeding source, the method comprising:

detecting a position of a fed sheet in a direction intersecting with a conveyance direction of the sheet; and setting, by a processor, a print start position in the direction intersecting with the conveyance direction based on the detected position of the sheet, wherein detecting includes not detecting the position of the sheet in a case where the sheet is fed from a first feeding source, and detecting includes detecting the position of the sheet in a case where the sheet is fed from a second feeding source, wherein the first feeding source and the second feeding source are included in a plurality of feeding sources that are different from each other in a distance to a printing unit.

18. A non-transitory computer-readable storage medium storing a program to cause a computer to execute a method for controlling a control device for a printing device having a printing unit and a plurality of feeding sources including a first feeding source and a second feeding source, the method comprising:

detecting a position of a fed sheet in a direction intersecting with a conveyance direction of the sheet; and setting, by a processor, a print start position in the direction intersecting with the conveyance direction based on the detected position of the sheet, wherein detecting includes not detecting the position of the sheet in a case where the sheet is fed from a first feeding source, and detecting includes detecting the position of the sheet in a case where the sheet is fed from a second feeding source, wherein the first feeding source and the second feeding source are included in a plurality of feeding sources that are different from each other in a distance to a printing unit.

* * * * *